US010316667B2

(12) United States Patent
Kim et al.

(10) Patent No.: US 10,316,667 B2
(45) Date of Patent: Jun. 11, 2019

(54) APPARATS FOR DECREASING THRUST OF RADIAL INFLOW TURBINE

(71) Applicant: Korea Maritime University Industry-Academic Cooperation Foundation, Busan (KR)

(72) Inventors: You Taek Kim, Busan (KR); Do Yeop Kim, Busan (KR); Jun Seong Kim, Busan (KR)

(73) Assignee: Korea Maritime University Industry-Academic Cooperation Foundation, Busan (KR)

( * ) Notice: Subject to any disclaimer, the term of this patent is extended or adjusted under 35 U.S.C. 154(b) by 373 days.

(21) Appl. No.: 15/197,525

(22) Filed: Jun. 29, 2016

(65) Prior Publication Data

US 2017/0030206 A1 Feb. 2, 2017

(30) Foreign Application Priority Data

Jul. 29, 2015 (KR) ..... 10-2015-0107044

(51) Int. Cl.
*F01D 5/04* (2006.01)

(52) U.S. Cl.
CPC ..... *F01D 5/046* (2013.01)

(58) Field of Classification Search
CPC ..... F01D 5/048; F01D 11/02; F01D 25/24; F05D 2240/24; F05D 2240/61; F05D 2260/15
See application file for complete search history.

(56) References Cited

U.S. PATENT DOCUMENTS 2,606,501 A * 8/1952 Dreibelbis ..... F01D 25/16 384/316
2,823,008 A * 2/1958 Constantine ..... F01D 5/046 416/181
2,938,661 A * 5/1960 Ricketts ..... F04D 29/102 415/111
2,973,135 A * 2/1961 Greenwald ..... F04D 25/04 415/105
3,163,003 A * 12/1964 Paul ..... F01D 11/04 60/39.08

FOREIGN PATENT DOCUMENTS

JP 56-103603 U1 8/1981
JP 61-166135 U1 10/1986
KR 10-0295011 B1 7/2001
KR 10-2004-0081075 A 9/2004

* cited by examiner

*Primary Examiner* — Ninh H. Nguyen
(74) *Attorney, Agent, or Firm* — Masuvalley & Partners

(57) ABSTRACT

Disclosed is an apparatus for decreasing a thrust of a radial flow turbine. The apparatus includes a rotary shaft having an axial through-hole in the interior thereof, a rotor assembled in the rotary shaft and having a rotor hub and rotor blades formed on an outer peripheral surface thereof, a casing configured to isolate the rotary shaft and the rotor from the outside, and a shaft seal configured to maintain a seal between the rotary shaft and the casing.

10 Claims, 7 Drawing Sheets

APPARATS FOR DECREASING THRUST OF RADIAL INFLOW TURBINE

CROSS-REFERENCE TO RELATED APPLICATIONS

A claim for priority under 35 U.S.C. § 119 is made to Korean Patent Application No. 10-2015-0107044 filed Jul. 29, 2015, in the Korean Intellectual Property Office, the entire contents of which are hereby incorporated by reference.

BACKGROUND

The inventive concept relates to an apparatus for decreasing a thrust of a radial flow turbine. More particularly, it relates to an apparatus for decreasing a thrust of a radial flow turbine, which decreases a pressure that influences a shaft seal.

A radial flow turbine is a turbine in which rotor blades are rotated with a working fluid such as vapor or gas flows radially on a plane perpendicular to a rotary shaft. The radial flow turbines may be classified into radial outflow turbines and radial inflow turbines. In the radial outflow turbine, vapor or gas is introduced into the center of the turbine to flow radially outwards, whereas in the radial inflow turbine, vapor or gas flows radially from the outer circumference to the inside of the turbine to drive rotor blades of the turbine.

Korean Patent Application Publication No. 10-2004-0081075 relates to a conduit apparatus for a radial flow turbine, and describes a technology of a conduit apparatus for a radial flow turbine of a type that significantly avoids disturbances of functions when blades (rotor blades) are adjusted.

Meanwhile, a high pressure ratio has recently been required for turbines to increase a pure output of a vapor power cycle and an organic Rankine cycle, due to the problem of lack of energy. Accordingly, recently, radial flow turbines have required a durability against a high thrust.

In general, a thrust bearing is installed to eliminate a thrust applied to a radial flow turbine. However, the thrust bearing decreases the efficiency of the radial flow turbine by generating work due to a non-conservative force. If a thrust bearing is excluded from a radial flow turbine that requires an excessive thrust force or the size of the thrust bearing is reduced, the development costs and the size of the radial flow turbine may be reduced and the efficiency of the radial flow turbine may be improved.

SUMMARY

Embodiments of the inventive concept describe an apparatus for decreasing a thrust of a radial flow turbine, and in more detail, provide a technology of an apparatus for decreasing a thrust of a radial flow turbine, which decreases a pressure that influences a shaft seal.

The embodiments provide an apparatus for decreasing a thrust of a radial flow turbine, which decreases a thrust by forming at least one ring on a back face (rotor back face) of a rotor of a radial flow turbine exposed to a relatively high pressure and forming a blind-hole in a rotary shaft of the radial flow turbine such that a pressure on the rotor back face decreases as the pressure goes from an inlet of the rotor towards a rotary shaft.

The embodiments also provides an apparatus for decreasing a thrust of a radial flow turbine, which satisfies a required performance of a shaft seal and reduce costs, by decreasing a pressure that influences the shaft seal by a ring formed on a back face of to rotor and a blind-hole formed in a rotary shaft.

In an aspect of the inventive concept, there is provided an apparatus for decreasing a thrust of a radial flow turbine, the apparatus including a rotary shaft having an axial blind-hole in the interior thereof, a rotor assembled in the rotary shaft and having a rotor hub and rotor blades formed on an outer peripheral surface thereof, a casing configured to isolate the rotary shaft and the rotor from the outside, and a shaft seal configured to maintain a seal between the rotary shaft and the casing.

According to an aspect, at least one protrusion is formed on a back face of the rotor hub, and at least one groove, by which the at least one protrusion is guided, is formed on an inner face of the casing, which faces the back face of the rotor hub.

According to another aspect, the at least one groove may be at least one ring-shaped groove, by which the at least one protrusion is guided.

According to another aspect, the at least one protrusion may be at least one protruding ring formed about the rotary shaft, and the at least one ring may be guided by the at least one groove.

According to another aspect, the at least one ring may include a plurality of rings having different diameters and the at least one groove may include a plurality of grooves guiding the plurality of rings to form a multi-ring structure.

According to another aspect, a first protruding ring and a second protruding ring having a diameter greater than that of the first ring may be formed on the back face of the rotor hub, and a first ring-shaped groove configured to guide the first ring and a second ring-shaped groove having a diameter greater than that of the first groove and configured to guide the second ring are formed on an inner face of the casing, which faces the back face of the rotor hub to form a dual ring structure.

According to another aspect, at least one protrusion may be formed on a back face of the rotor hub, a disk facing the back face of the rotor hub may be formed on an inner face of the casing, and at least one groove, by which the at least one protrusion is guided, may be formed on a front face of the disk.

According to another aspect, the blind-hole may be formed in the interior of the rotary shaft, in which the rotor is disposed, and is hollowed to a front end of a diffuser.

According to another aspect, the at least one ring may be integrally formed with the rotor hub.

In accordance with another aspect of the inventive concept, there is provided an apparatus for decreasing a thrust of a radial flow turbine, the apparatus including a rotary shaft, a rotor formed on an outer peripheral surface of the rotary shaft and rotated by a working fluid, a casing configured to isolate the rotary shaft and the rotor from the outside, and a shaft seal configured to maintain a seal between the rotary shaft and the casing, wherein a plurality of protruding rings having different diameters are formed on a back face of the rotor, and a plurality of ring-shaped grooves, by which the plurality of rings are guided, are formed on an inner face of the casing, which faces a back face of the rotor.

According to an aspect, the rotary shaft may have a blind-hole axially extending to a front end of a diffuser in the interior thereof.

According to another aspect, the plurality of rings may be integrally formed with the rotor.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
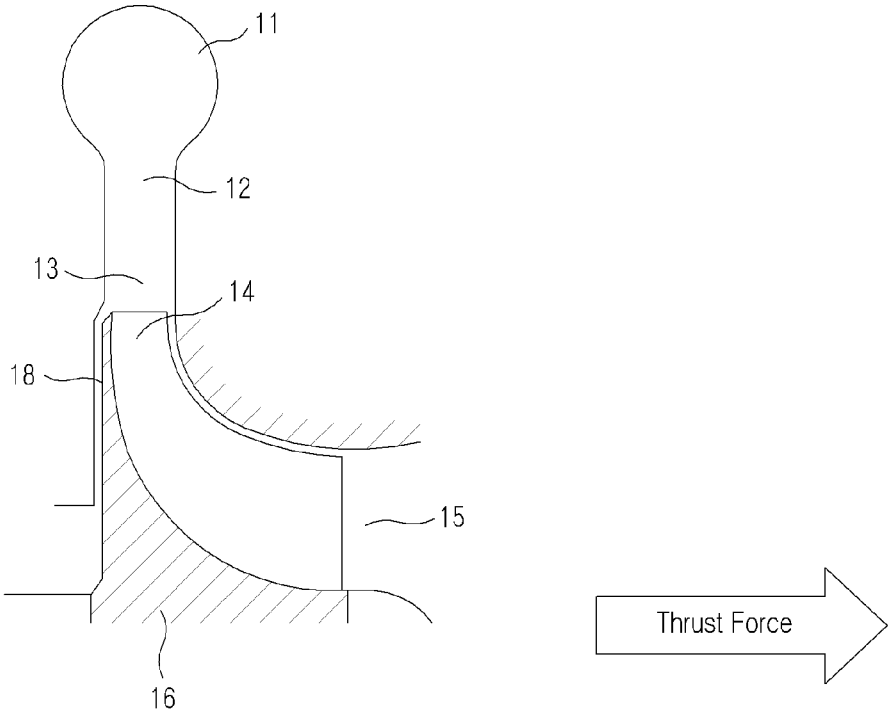
FIG. 1 is a view illustrating a fluid flow direction of a radial flow turbine according to an embodiment.

Hereinafter, embodiments of the inventive concept will be described with reference to the accompanying drawings. However, the embodiments may be modified into other various forms, and the scope of the inventive concept is not limited by the embodiments. Further, the embodiments are provided to describe the inventive concept to those skilled in the art more completely. In the drawings, the shapes and sizes of the elements may be exaggerated for clearer description.

The following embodiments relate to a technology for decreasing a thrust of a radial flow turbine, and more particularly to an apparatus for decreasing a thrust of a radial flow turbine, which decreases a pressure that influences a shaft seal.

A thrust bearing may be made unnecessary or the size of a thrust bearing may be reduced by decreasing a thrust of the radial flow turbine, making it possible to reduce the size of the radial flow turbine or decrease development costs, and a performance index required for a shaft seal may be attenuated by decreasing a pressure that influences a shaft seal.

FIG. 1 is a view illustrating a fluid flow direction of a radial flow turbine according to an embodiment.

Referring to FIG. 1, a working fluid of the radial flow turbine is introduced radially and discharged axially. Hereinafter, a fluid flow direction of a radial inflow turbine, as a representative of radial flow turbines, will be described.

In the radial flow turbine, a working fluid may be introduced radially from a volute 11 through a nozzle 12, may be introduced into a rotor 14 through an interface 13, and may be discharged axially towards a diffuser 15.

In more detail, the working fluid of a high temperature and a high pressure, which is heated by an evaporator, is guided to the nozzle 12 via a volute 11, and is accelerated in the nozzle 12 such that the flow of the working fluid is rectified while the working fluid passes through the interface 13. Thereafter, the rotor 14 retrieves energy of the working fluid, and the pressure of the working fluid may be recovered through the diffuser 15 such that the working fluid is smoothly condensed by a condenser. That is, the energy of the working fluid may be converted into rotational energy by rotor blades arranged on a rotor hub 16, and the rotor blades may discharge a gas that has consumed energy in the direction of a rotary shaft.

The working fluid in the volute 11 or the nozzle 12, a pressure of which is relatively high, is applied to a back face 18 of the rotor 14 in the radial flow turbine to generate an axial thrust. Because the magnitude of the thrust is proportional to a difference between the area of the back face 18 of the rotor and the projection area of an exit of the rotor 14, and a difference between the pressures of an inlet and an exit of the rotor 14, the thrust increases when the radius of the inlet of the rotor 14 is large or a pressure ratio (Pinlet/Pexit) required by the radial flow turbine is large.

Meanwhile, a high pressure ratio has recently been required for turbines to increase a pure output of a vapor power cycle and an organic Rankine cycle, due to the problem of lack of energy. Accordingly, recently, radial flow turbines have required a durability against a high thrust. In general, a thrust bearing is installed to eliminate a thrust applied to a radial flow turbine. However, because the thrust bearing decreases the efficiency of the radial flow turbine by generating work due to a non-conservative force, it is preferable to exclude a thrust bearing or decrease the size of a thrust bearing.

An apparatus for decreasing a thrust of a radial flow turbine according to an embodiment will be described with reference to FIGS. 2 to 4.

Figure 2:
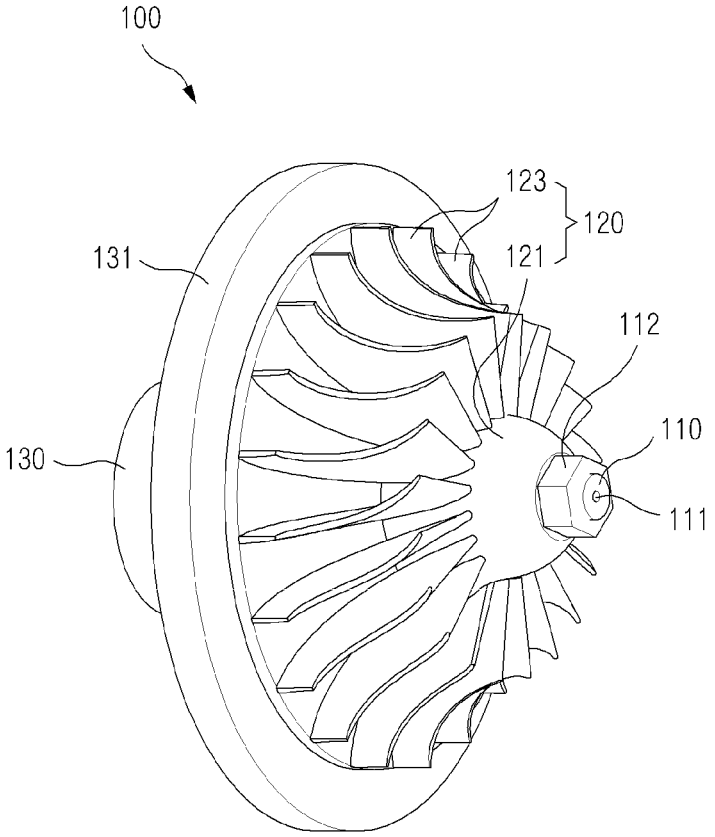
FIG. 2 is a perspective view illustrating an apparatus for decreasing a thrust of a radial flow turbine according to an embodiment.

FIG. 2 is a perspective view illustrating an apparatus for decreasing a thrust of a radial flow turbine according to an embodiment. FIG. 3 is a front view illustrating an apparatus for decreasing a thrust of a radial flow turbine according to an embodiment. FIG. 4 is a rear view illustrating an apparatus for decreasing a thrust of a radial flow turbine according to an embodiment.

Figure 3:
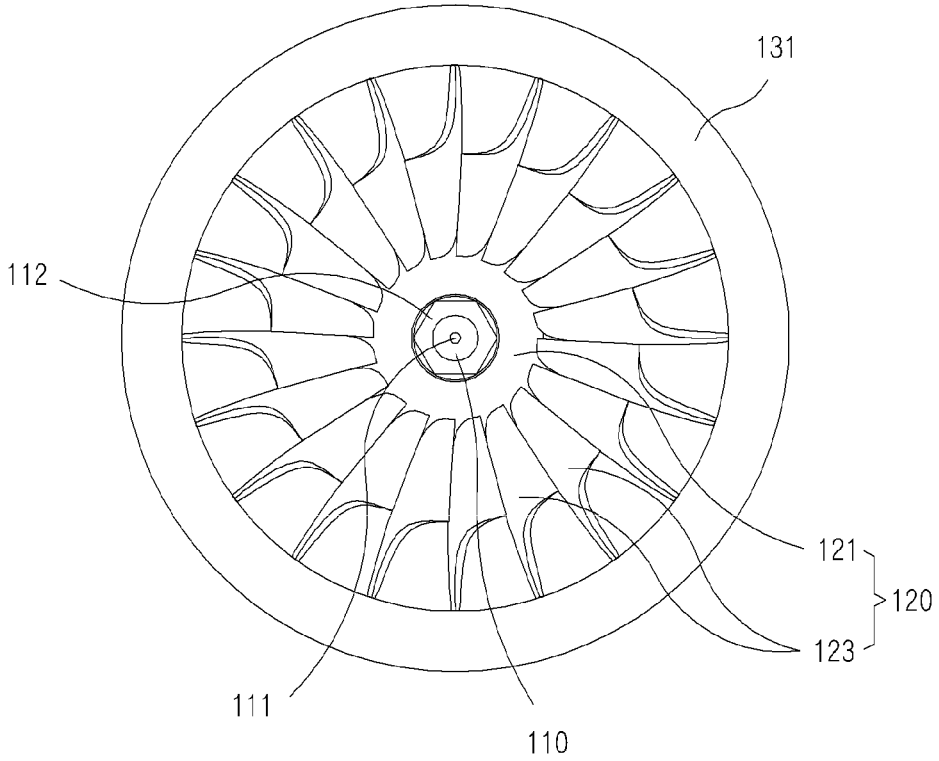
FIG. 3 is a front view illustrating an apparatus for decreasing a thrust of a radial flow turbine according to an embodiment.
Figure 4:
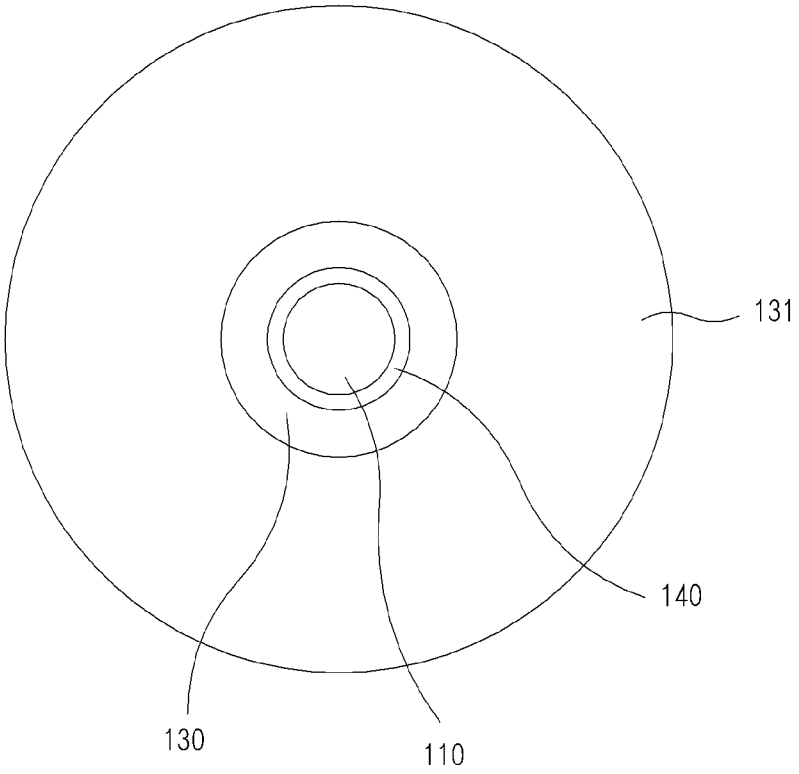
FIG. 4 is a rear view illustrating an apparatus for decreasing a thrust of a radial flow turbine according to an embodiment.

Referring to FIGS. 2 to 4, the apparatus 100 for decreasing a thrust of a radial flow turbine may include a rotary shaft 110, a rotor 120, a casing 130, and a shaft seal 140. Further, although not illustrated, the casing 130 may extend to block the rotary shaft 110 and the rotor 120 from the outside.

The rotary shaft 110 is formed in the interiors of the rotor 120 and the casing 130, and may be rotated together with rotor blades 123 and a rotor hub 121 by a working fluid. An axial blind-hole 111 is formed in the interior of the rotary shaft 110 to decrease an axial thrust and a pressure that influences the shaft seal 140. For example, the blind-hole 111 may be formed in the interior of the rotary shaft 110, in which the rotor 120 is disposed, and may be hollowed to a front end of a diffuser.

The rotor 120 may include a rotor hub 121 and rotor blades 123.

The rotor 120 may be assembled on one side of the rotary shaft 110, and may include the rotor hub 121 and the rotor blades 123 formed on an outer peripheral surface of the rotor hub 121 to be rotated about the rotary shaft 110.

For example, a dual ring or a multi-ring having a protruding shape may be formed on a back face of the rotor hub 121. The dual ring or multi-ring may be coupled to a ring-shaped groove formed in the casing 130.

The rotor blades 123 may be arranged around the rotor hub 121, and in more detail, may be formed radially on an outer peripheral surface of the rotor hub 121. The rotor blades 123 may be rotated by a working fluid, and may be attached or coupled to the rotor hub 121 to be rotated.

The rotor 120 applies a rotational force to the rotor blades 123 to convert energy of the working fluid into mechanical work as the rotor blades 123 is rotated about the rotary shaft 110.

The casing 130 may isolate the rotary shaft 110 and the rotor 120 from the outside. The casing 130 is formed outside the rotary shaft 110 and the rotor 120, and at least an interior portion of the casing 130 faces the back face of the rotor 120 rotated by the working fluid while being spaced apart from the back face of the rotor 120 by a predetermined distance. For example, a ring-shaped groove may be formed on an inner face of the casing 130, and the ring-shaped groove may be coupled the protruding dual ring or multi-ring formed in the rotor hub 121, correspondingly.

The shaft seal 140 may be formed between the rotary shaft 110 and the casing 130 to maintain a seal.

In this way, because the apparatus 100 for decreasing a thrust of a radial flow turbine according to an embodiment is configured such that a blind-hole 111 is formed in the interiors of the dual ring or multi-ring structure and the rotary shaft 110, a pressure formed on the back face of the rotor hub 121 may gradually decrease from inlets of the rotor blades 123 towards the rotary shaft 110 to decrease an axial thrust.

When a radial thrust is generated, the rotor 120 may be pushed towards one side so that power consumption increases as the casing 130 and the rotor 120 make contact with each other and the materials of the elements are worn out.

Accordingly, the apparatus 100 for decreasing a thrust of a radial flow turbine according to an embodiment may decrease a thrust of the radial flow turbine, or may exclude a thrust bearing or reduce the size of a thrust bearing, thereby decreasing the size of the radial flow turbine or development costs. Further, a high performance may be obtained by reducing power consumption and wearing of the materials.

Hereinafter, the apparatus for decreasing a thrust of a radial flow turbine according to the embodiment will be described in more detail with reference to FIGS. 5 and 6.

Figure 5:
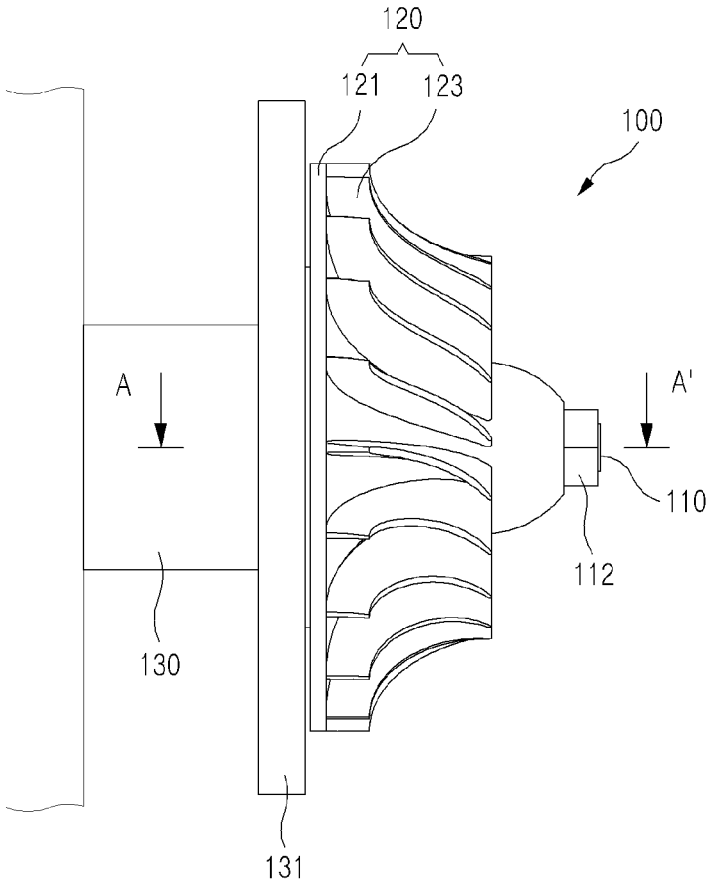
FIG. 5 is a side view illustrating an apparatus for decreasing a thrust of a radial flow turbine according to an embodiment.

FIG. 5 is a side view illustrating an apparatus for decreasing a thrust of a radial flow turbine according to an embodiment. FIG. 6 is a sectional view taken along line A-A' in FIG. 5.

Figure 6:
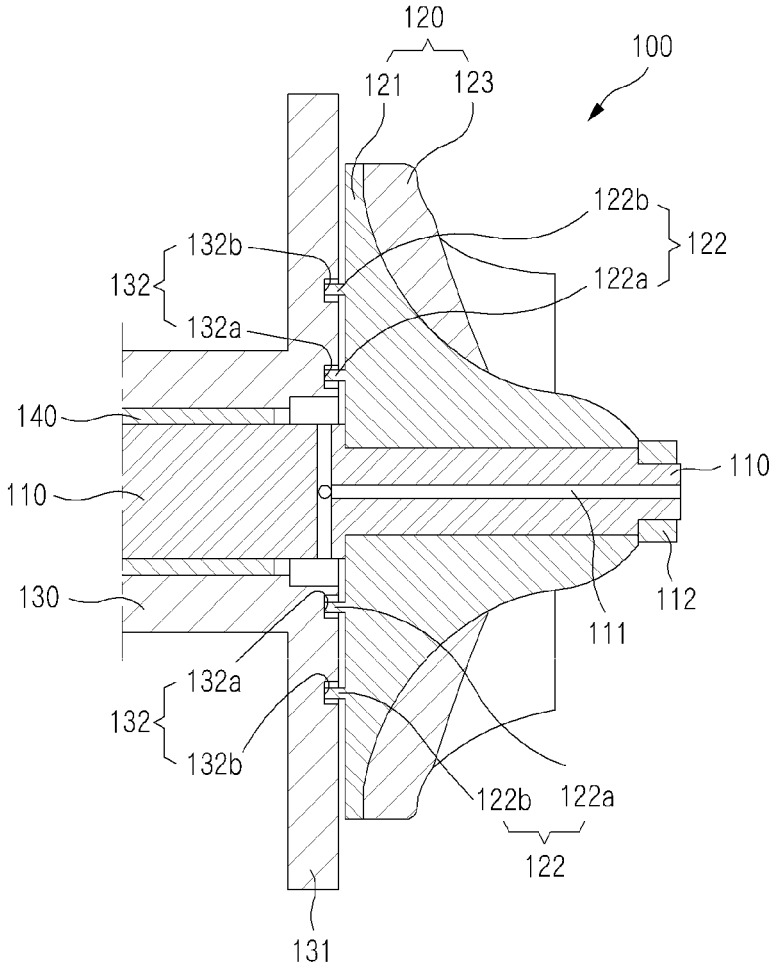
FIG. 6 is a sectional view taken along line A-A' in FIG. 5.

Referring to FIGS. 5 to 6, the apparatus 100 for decreasing a thrust of a radial flow turbine may include a rotary shaft 110, a rotor 120, a casing 130, and a shaft seal 140. Here, the rotor 120 may include a rotor hub 121 and rotor blades 123.

The rotary shaft 110 is formed in the interiors of the rotor 120 and the casing 130, and the rotor blades 123 and the rotor hub 121 may be rotated about the rotary shaft 110 by a working fluid.

An axial blind-hole 111 may be formed in the interior of the rotary shaft 110, and in particular, the interior of the rotary shaft 110, in which the rotor 120 is disposed, may be hollowed. The blind-hole 111 may extend axially and may be hollowed to a front end of a diffuser, which is the lowest pressure part of a passage of the radial flow turbine.

The rotor 120 may include a rotor hub 121 and rotor blades 123.

The rotor hub 121 is assembled on one side of the rotary shaft 110, and the rotor blades 123 may be formed on an outer peripheral surface of the rotor hub 121. At least one protrusion 122 may be formed on a back face of the rotor hub 121 to decrease a pressure generated on the back face of the rotor.

Then, the at least one protrusion 122 may be integrally formed with the rotor hub 121, but the inventive concept is not limited thereto.

Further, the at least one protrusion 122 may be at least one protruding ring 122 formed about the rotary shaft 110. The at least one ring 122 may be integrally formed with the rotor hub 121 through machining to maintain a predetermined strength during rotation.

The rotor blades 123 may be radially formed on an outer peripheral surface of the rotor hub 121 to be rotated about the rotary shaft 110 by a working fluid together with the rotor hub 121.

Meanwhile, the rotor hub 121 may be formed integrally with the rotor blades 123 or formed separately from the rotor blades 123 to be attached and coupled to the rotor blades 123.

The casing 130 may isolate the rotary shaft 110 and the rotor 120 from the outside.

The casing 130 is formed outside the rotary shaft 110 and the rotor 120, and at least an interior portion of the casing 130 faces the back face of the rotor 120 rotated by the working fluid.

At least one groove 132, by which the at least one protrusion 122 is guided, may be formed on an inner face of the casing 130 through machining.

The at least one groove 132 may be at least one ring-shaped groove, by which the at least one protrusion 122 or the at least one ring 122 is guided. Accordingly, at least a portion of the protruding ring formed on the back face of the rotor hub 121 may be inserted into or coupled to the ring-shaped groove formed in the casing 130, and may be guided during rotation of the rotor.

Further, a disk 131 facing the back face of the rotor hub 121 may be formed integrally with or separately from the inner face of the casing 130. The disk 131 may be a circular plate, and may be formed integrally with the casing 130 or formed separately from the casing 130 to be coupled to the casing 130. The front face of the disk 131 may be formed to face the back face of the rotor hub 121, and at least one groove 132, by which the at least one protrusion 122 is guided, may be formed on the front face of the disk 131.

That is, the at least one protrusion 122 may be formed on the back face of the rotor hub 121, the disk 131 facing the back face of the rotor hub 121 may be formed on the inner face of the casing 130, and the at least one groove 132, by which the at least one protrusion 122 is guided, may be formed on the front face of the disk 131. Accordingly, the at least one protrusion 122 may be fitted with the at least one groove 132, and the protrusion 122 may be moved along the groove 132 as the rotor hub 121 is rotated.

Here, the at least one groove 132 may have a ring shape, and may be coupled to and guided by the at least one ring 122 formed on the back face of the rotor hub 121.

As described above, the apparatus 100 for decreasing a thrust of a radial flow turbine includes a rotary shaft 110, a rotor 120 including a rotor hub 121 and rotor blades 123, a casing 130, and a shaft seal 140, and at least one protrusion 122 is formed in the rotor hub 121 and at least one groove 132 is formed in the casing 130 such that rotation of the protrusion 122 may be guided by the groove 132.

As an example, the at least one protrusion 122 may be formed on the back face of the rotor hub 121, and the at least one groove 132, by which the at least one protrusion 122 is guided, may be formed on the inner face of the casing 130, which faces the back face of the rotor hub 121. Accordingly, as the rotor hub 121 is rotated, at least a portion of the protrusion 122 may be inserted into the groove 132 and may be guided by and moved along the groove 132.

As another example, the at least one groove 132 may be at least one ring-shaped groove, by which the at least one protrusion 122 is guided. That is, the at least one protrusion 122 may be formed on the back face of the rotor hub 121, and the at least one ring-shaped groove 132, by which the at least one protrusion 122 is guided, may be formed on the inner face of the casing 130, which faces the back face of the rotor hub 121.

As another example, the at least one protrusion 122 may be at least one protruding ring 122 formed about the rotary shaft 110, and the at least one ring 122 may be guided by the at least one ring-shaped groove 132.

Then, the at least one ring 122 may include a plurality of rings having different diameters. Further, the at least one groove 132 may include a plurality of grooves 132 guiding the plurality of rings 122, and a multi-ring structure in which the plurality of rings 122 may be inserted into the plurality of grooves 132, respectively, to be guided during rotation may be formed.

Hereinafter, a dual ring structure of the apparatus for decreasing a thrust of a radial flow turbine may be described as an example with reference to FIG. 6.

As illustrated in FIG. 6, a first protruding ring 122*a* and a second protruding ring 122*b* having a diameter greater than that of the first ring 122*a* may be formed on a back face of the rotor hub 121. Correspondingly, a first groove 132*a*, by which the first ring 122*a* is guided, may be formed on an inner face of the casing 130, which faces the back face of the rotor hub 121, and a second groove 132*b* having a diameter greater than that of the first groove 132*a*, by which the second ring 122*b* is guided, may be formed. That is, at least a portion of the first ring 122*a* may be inserted into the first groove 132*a* to be guided as the first ring 122*a* is rotated, and at least a portion of the second ring 122*b* may be inserted into the second groove 132*b* to be guided as the second ring 122*b* is rotated, in order to form a dual ring structure.

At least one protrusion 122 may be formed on the back face of the rotor hub 121, a disk 131 facing the back face of the rotor hub 121 may be formed on the inner face of the casing 130, and at least one groove 132, by which the at least one protrusion 122 is guided, may be formed on the front face of the disk 131.

Meanwhile, as the rotor blades 123 rotated by a working fluid, the rotor hub 121 coupled to the rotor blades 123, and the rotor shaft 110 are rotated, the rotary shaft 110 in the casing 130 also may be rotated.

While a pressure of a volute or a nozzle is applied to the entire back face of a rotor relatively constantly in an existing radial flow turbine, the apparatus for decreasing a thrust of a radial flow turbine according to the embodiment may gradually decreases a pressure on the back face of the rotor 120 or the rotor hub 121 as the pressure goes from an inlet of the rotor towards the rotary shaft 110 due to the multiple rings 122 and the blind-hole 111 and thus may decrease a thrust.

Moreover, because the multiple rings 122 and the blind-hole 111 decreases a pressure that influences the shaft seal 140, the apparatus may satisfy the required performance of the shaft seal 140 and may reduce costs.

The shaft seal 140 is an apparatus for maintaining a seal or preventing a leakage, and may be used for the purpose of preventing a fluid of a high pressure from being leaked to the outside at a portion of the shaft seal, which passes through the casing or air from being introduced from the outside to a lower pressure side. It is necessary to minimize the pressure that influences the shaft seal 140 in order to prevent leakage of the shaft seal 140.

Figure 7:
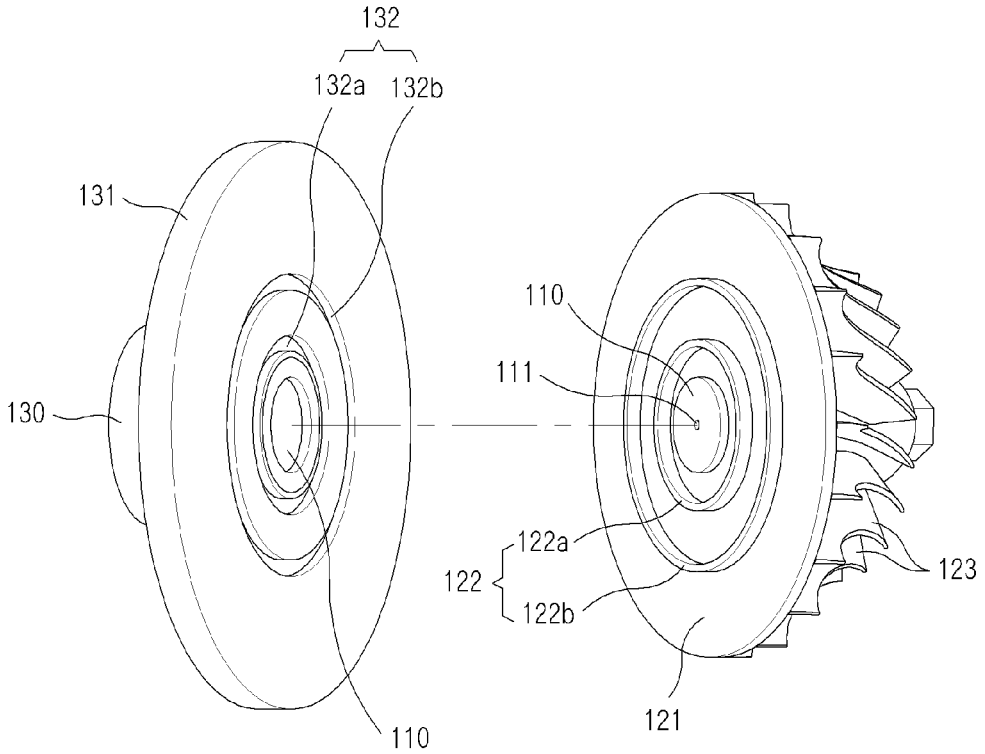
FIG. 7 is an exploded view illustrating an apparatus for decreasing a thrust of a radial flow turbine according to an embodiment.

FIG. 7 is an exploded view illustrating an apparatus for decreasing a thrust of a radial flow turbine according to an embodiment.

Referring to FIG. 7, the apparatus 100 for decreasing a thrust of a radial flow turbine may include a rotary shaft 110, a rotor 120, a casing 130, and a shaft seal 140. Further, although not illustrated, the casing 130 may extend to block the rotary shaft 110 and the rotor 120 from the outside.

Here, the at least one protrusion 122 may be formed on the back face of the rotor hub 121, and the at least one groove 132, by which the at least one protrusion 122 is guided, may be formed on the inner face of the casing 130, which faces the back face of the rotor hub 121.

For example, a first protruding ring 122*a* and a second protruding ring 122*b* may be formed on a back face of the rotor hub 121. Here, the second ring 122*b* may be a second protruding ring 122*b* having a diameter greater than that of the first ring 122*a*.

Further, a first groove 132*a* and a second groove 132*b* may be formed on an inner face of the casing 130, which faces the back face of the rotor hub 121, to correspond to the first ring 122*a* and the second ring 122*b*.

That is, a first groove 132*a*, by which the first ring 122*a* is guided, may be formed on an inner face of the casing 130 and a second groove 132*b* having a diameter greater than that of the first groove 132*a*, by which the second ring 122*b* is guided, may be formed. That is, the first ring 122*a* is coupled to the first groove 132*a*, and the second ring 122*b* may be coupled to the second groove 132*b* in order to a dual ring structure.

As another example, the at least one protrusion 122 may be formed on the back face of the rotor hub 121, the disk 131 facing the back face of the rotor hub 121 may be formed on the inner face of the casing 130, and the at least one groove 132, by which the at least one protrusion 122 is guided, may be formed on the front face of the disk 131.

That is, a first protruding ring 122*a* and a second protruding ring 122*b* may be formed on a back face of the rotor hub 121. Here, the second ring 122*b* may be a second protruding ring 122*b* having a diameter greater than that of the first ring 122*a*.

Further, because a first ring-shaped groove 132*a*, by which the first ring 122*a* is guided, and a second ring-shaped groove 132*b* having a diameter greater than the first groove 132*a*, by which the second ring 122*b* is guided, are formed on a front face of the disk 131, which faces the back face of the rotor hub 121, to correspond to the first ring 122*a* and the second ring 122*b*, the first ring 122*a* is coupled to the first groove 132*a* and the second ring 122*b* is coupled to the second groove 132*b* in order to form a dual ring structure.

Although the dual ring structure has been described as an example, a single ring structure and a multi-ring structure may be formed instead of the dual ring structure.

Hereinafter, the apparatus for decreasing a thrust of a radial flow turbine according to another embodiment will be described.

The apparatus 100 for decreasing a thrust of a radial flow turbine according to the embodiment may include a rotary shaft 110, a rotor 120, a casing 130, and a shaft seal 140. These elements may be described in detail by using the apparatus 100 for decreasing a thrust of a radial flow turbine according to the embodiments of FIGS. 2 to 7.

The rotor 120 may be formed on an outer peripheral surface of the rotary shaft 110 to be rotated by a working fluid. The rotor 120 may have radial rotor blades 123.

Here, an axial blind-hole 111 may be formed in the interior of the rotary shaft 110, in which the rotor 120 is disposed. The blind-hole 111 may extend axially to a front end of a diffuser.

A plurality of protruding rings 122 having different diameters may be formed on a back face of the rotor 120 through machining. The plurality of rings 122 may be integrally formed with the rotor 120, but the inventive concept is not limited thereto.

The casing 130 may be formed outside the rotary shaft 110 to isolate the rotary shaft 110 and the rotor 120 from the outside.

A plurality of ring-shaped grooves 132, by which the plurality of rings 122 are guided, respectively, may be formed on an inner face of the casing 130 through machining.

That is, because a plurality of protruding rings 122 having different diameters are formed on a back face of the rotor 120 and a plurality of ring-shaped grooves 132, by which the plurality of rings are guided, are formed on an inner face of the casing 130, which faces the back face of the rotor 120, the plurality of rings 122 may be inserted into and coupled to the plurality of grooves 132.

For example, a dual ring 122 integrally machined with the rotor 120 may be formed on the back face of the rotor of the radial flow turbine, which is exposed to a relatively high pressure. Here, it is not necessary to radially form several rings 122 according to occasions to form a multi-ring, and the rings 122 may not be integral with the rotor 120.

The shaft seal 140 may be formed between the rotary shaft 110 and the casing 130 to maintain a seal.

According to the embodiments, the rotary shaft 110 of the radial flow turbine may have a blind-hole 111 hollowed to a front end of the diffuser, which is the lowest pressure part of the turbine passage. While a pressure of a volute or a nozzle is applied relatively constantly to the entire back face of the rotor in the structure of an existing radial flow turbine, a pressure on the back face of the rotor gradually decreases as the pressure goes from the inlet of the rotor towards the rotary shaft 110 due to the multiple rings and the blind-hole in the radial flow turbine according to the embodiments. Accordingly, the axial thrust may be reduced.

Moreover, because the multiple rings 122 and the blind-hole 111 decreases a pressure that influences the shaft seal 140, the apparatus may satisfy the required performance of the shaft seal 140 and may reduce costs.

According to the embodiments, an apparatus 100 for decreasing a thrust of a radial flow turbine, which decreases a thrust by forming at least one ring 122 on a back face of a rotor 120 of a radial flow turbine exposed to a relatively high pressure and forming a blind-hole 111 in a rotary shaft 110 of the radial flow turbine such that a pressure on the rotor 120 back face decreases as the pressure goes from an inlet of the rotor 120 towards a rotary shaft 110 may be provided.

Further, according to the embodiments, an apparatus 100 for decreasing a thrust of a radial flow turbine, which maximizes a performance of a shaft seal 140 and reduce costs, by decreasing a pressure that influences the shaft seal 140 by a ring 122 formed on a back face of the rotor 120 and a blind-hole 111 formed in a rotary shaft 110 may be provided.

Although the embodiments of the inventive concept have been described with reference to the limited embodiments and the drawings, the inventive concept may be variously corrected and modified from the above description by those skilled in the art to which the inventive concept pertains. For example, the above-described technologies can achieve a suitable result even though they are performed in different sequences from those of the above-mentioned method and/or coupled or combined in different forms from the method in which the constituent elements such as the system, the architecture, the device, or the circuit are described, or replaced or substituted by other constituent elements or equivalents.

Therefore, the other implementations, other embodiments, and the equivalents of the claims pertain to the scope of the claims.

What is claimed is:

1. An apparatus for decreasing a thrust of a radial flow turbine, the apparatus comprising:

a rotary shaft having an axial blind-hole in the interior thereof;

a rotor assembled in the rotary shaft and having a rotor hub and rotor blades formed on an outer peripheral surface thereof;

a casing configured to isolate the rotary shaft and the rotor from the outside; and a shaft seal configured to maintain a seal between the rotary shaft and the casing, wherein the interior of the rotary shaft in which the rotor is disposed is hollowed by the axial blind-hole such that a pressure that influences the shaft seal is decreased, and an end of the axial blind-hole is radially connected and guided to a back face of the rotor hub and the shaft seal to decrease said pressure that influences the shaft seal, and wherein at least one protrusion is formed on a back face of the rotor hub, and at least one groove, by which the at least one protrusion is guided, is formed on an inner face of the casing, which faces the back face of the rotor hub such that a pressure formed on the back face of the rotor hub is gradually decreased from inlets of the rotor towards the rotary shaft to decrease an axial thrust.

2. The apparatus of claim 1, wherein the at least one groove is at least one ring-shaped groove, by which the at least one protrusion is guided.

3. The apparatus of claim 2, wherein the at least one protrusion is at least one protruding ring formed about the rotary shaft, and the at least one ring is guided by the at least one groove.

4. The apparatus of claim 3, wherein the at least one ring comprises a plurality of rings having different diameters and the at least one groove comprises a plurality of grooves guiding the plurality of rings to form a multi-ring structure.

5. The apparatus of claim 3, wherein the at least one ring is integrally formed with the rotor hub.

6. The apparatus of claim 1, wherein a first protruding ring and a second protruding ring having a diameter greater than that of the first ring are formed on the back face of the rotor hub, and a first ring-shaped groove configured to guide the first ring and a second ring-shaped groove having a diameter greater than that of the first groove and configured to guide the second ring are formed on an inner face of the casing, which faces the back face of the rotor hub to form a dual ring structure.

7. The apparatus of claim 1, wherein at least one protrusion is formed on a back face of the rotor hub, a disk facing the back face of the rotor hub is formed on an inner face of the casing, and at least one groove, by which the at least one protrusion is guided, is formed on a front face of the disk.

8. An apparatus for decreasing a thrust of a radial flow turbine, the apparatus comprising:

a rotary shaft;

a rotor formed on an outer peripheral surface of the rotary shaft and rotated by a working fluid;

a casing configured to isolate the rotary shaft and the rotor from the outside; and a shaft seal configured to maintain a seal between the rotary shaft and the casing, wherein a plurality of protruding rings having different diameters are formed on a back face of the rotor, and a plurality of ring-shaped grooves, by which the plurality of rings are guided, are formed on an inner face of the casing, which faces a back face of the rotor, wherein the interior of the rotary shaft in which the rotor is disposed is hollowed by the axial blind-hole such that a pressure that influences the shaft seal is decreased, and an end of the axial blind-hole is radially connected and guided to a back face of the rotor hub and the shaft seal to decrease said pressure that influences the shaft seal, and wherein at least one protrusion is formed on a back face of the rotor hub, and at least one groove, by which the at least one protrusion is guided, is formed on an inner face of the casing, which faces the back face of the rotor hub such that a pressure formed on the back face of the rotor hub is gradually decreased from inlets of the rotor towards the rotary shaft to decrease an axial thrust.

9. The apparatus of claim 8, wherein the rotary shaft has a blind-hole axially extending to a front end of a diffuser in the interior thereof.

10. The apparatus of claim 8, wherein the plurality of rings are integrally formed with the rotor.

* * * * *